US006109973A

United States Patent [19]

Gronowicz, Jr. et al.

[11] Patent Number: 6,109,973

[45] Date of Patent: Aug. 29, 2000

[54] ELECTRICAL CONNECTOR WITH COMBINED TERMINAL RETAINER AND CIRCUIT COMPONENT

[75] Inventors: William Gronowicz, Jr., Westland; Otoniel Hinojosa, Melvindale; Joseph Stanley Warner, Flatrock, all of Mich.

[73] Assignee: Yazaki North America, Inc., Canton, Mich.

[21] Appl. No.: 09/349,284

[22] Filed: Jul. 8, 1999

[51] Int. Cl.[7] ..... H01R 13/66; H01R 13/68; H01R 13/40

[52] U.S. Cl. ..... 439/620; 439/621; 439/622; 439/595; 439/598

[58] Field of Search ..... 439/620, 595, 439/598, 621, 622

[56] References Cited

U.S. PATENT DOCUMENTS

| | | | |
|---|---|---|---|
| 4,333,701 | 6/1982 | Schick . | |
| 4,944,696 | 7/1990 | Sueyoshi et al. . | |
| 5,055,071 | 10/1991 | Carlson et al. . | |
| 5,057,041 | 10/1991 | Yu et al. | 439/620 |
| 5,221,215 | 6/1993 | Tan et al. | 439/620 |
| 5,577,937 | 11/1996 | Itoh et al. | 439/620 |
| 5,682,130 | 10/1997 | Styrna et al. . | |
| 5,818,676 | 10/1998 | Gronowicz, Jr. . | |
| 5,951,328 | 9/1999 | Roper, Jr. | 439/621 |
| 6,010,366 | 1/2000 | Tanigawa et al. | 439/620 |

FOREIGN PATENT DOCUMENTS 5-73843 of 0000 Japan .

*Primary Examiner*—Gary F. Paumen
*Assistant Examiner*—Edwin A. León
*Attorney, Agent, or Firm*—Young & Basile

[57] ABSTRACT

An electrical connector has a plurality of internal chambers containing wiring harness terminals for making connection with terminals of a mating wiring harness connector, and a locking wedge receptacle adjacent the terminal chambers having a plurality of electrical component terminals in communication therewith. Latch members separate the terminal chambers from the locking wedge receptacle and have nubs formed thereon which engage the terminals to retain them in their respective chambers. An electrical circuit component such as a fuse, resistor, capacitor or diode is sized to fit snugly within the locking wedge receptacle and has contacts which make electrical connection with the electrical component terminals when inserted therein. Insertion of the circuit component into the locking wedge receptacle places the body of the circuit component in contact with the latch members so that they are maintained in engagement with their respective wiring harness terminals, thereby locking the terminals securely in their respective terminal chambers.

18 Claims, 4 Drawing Sheets

113
100
106
108
102
104
114

113
104
106
112
114
116
108
110
102

ELECTRICAL CONNECTOR WITH COMBINED TERMINAL RETAINER AND CIRCUIT COMPONENT

FIELD OF THE INVENTION

This invention is directed in general to an electrical connector of the type used to interconnect vehicle wiring harnesses, and more specifically to such a connector that uses a locking member to retain wire harness terminals within the connector.

BACKGROUND OF THE INVENTION

Electrical junction boxes are typically used in automotive vehicles to streamline electrical wiring by eliminating multi-branch wiring. The junction box consolidates branch circuits, fuses, relays and other electrical circuit components into a single location. The junction box is usually located within a vehicle engine compartment and electrical connectors mounted on the box receive mating wiring harness connectors to connect the circuit components with various vehicle electrical devices, such as headlights, fuel pumps, windshield wiper motors and ignition switches.

The circuit components typically plug into cavities or receptacles in the junction box and have contacts in the form of blades or prongs that project through slots in the box to connect with bus bars or other conductive means housed within the box to join the components into electrical circuits. As the number and complexity of vehicle electrical systems has increased, the number of circuit components which must be mounted on a junction box has multiplied. Junction boxes are allotted a limited amount of space within an engine compartment, and once the available surface area of the box is fully utilized other locations for the necessary additional circuit components must be found.

One possible alternative to mounting circuit components on a junction block it to put them in line with a wire at some location remote from the block. U.S. Pat. No. 5,055,071 is an example of an in-line fuse holder for connecting a double-bladed fuse in series with an electrical wire. U.S. patent application Ser. No. 09/076,427, filed May 12, 1998, and assigned to the assignee of this application, discloses an electrical terminal having an integral positive temperature coefficient (PTC) device to protect associated circuitry against over-current conditions. Such a terminal eliminates the need for a separate circuit protection device associated with the particular wire to be located on a junction box, and may be incorporated into a multipin electrical connector. PTC overcurrent protection devices do not require replacement after an overcurrent condition has occurred. Rather, PTC devices are "self-resetting", so that once the overcurrent condition has ceased and the PTC device has cooled down to the normal operating temperature range, the device resumes normal operation and continues to provide protection for the circuit. The structure and operation of PTC devices are described in detail in U.S. Pat. No. 5,796,569, the disclosure of which is incorporated herein by reference.

FIGS. 1 and 2 show a prior art electrical connector 100 wherein terminals 102 attached to the ends of wires 113 are inserted into terminal chambers 104 within a connector housing 106 and held in place by flexible latch members 108 formed integrally with the connector housing. A rounded nub 110 on the surface of each latch member engages a shoulder 112 formed on the terminal 102 to prevent it from being pushed out of its chamber 104 by contact with a mating terminal, or pulled out of its chamber by tension on its attached wire 113. After the terminals 102 are inserted into their chambers 104, a locking wedge 114 is inserted into a receptacle 116 formed in the connector housing 106 adjacent the chambers 104 to wedge the latch members 108 into engagement with their respective terminals 102 and thereby positively lock them in place.

SUMMARY OF THE INVENTION

In carrying out this invention in the illustrative embodiment thereof, an electrical connector comprises a housing with a plurality of internal chambers containing first electrical terminals for making connection with terminals of a mating connector, and a locking wedge receptacle adjacent the terminal chambers having a plurality of electrical component terminals in communication therewith. Latch members separate the terminal chambers from the receptacle and have bumps or nubs formed thereon which engage the terminals to retain them in their respective chambers.

An electrical circuit component such as a fuse, resistor, capacitor or diode is modified or specially formed to fit snugly within the locking wedge receptacle such that its contacts which make electrical connection with the electrical component terminals when inserted therein. Insertion of the circuit component into the receptacle places the body of the circuit component in contact with the latch members so that they are wedged or maintained in engagement with their respective terminals, thereby locking the terminals securely in their respective terminal chambers.

In the preferred embodiment of the invention, the electrical component is a positive temperature coefficient (PTC) circuit over-current protection device. Such a PTC device may be made very thin so that the receptacle for receiving the PTC device does not add significantly to the overall size of the connector, and does not require replacement after an overcurrent condition in the circuit.

In a first disclosed embodiment of the invention, the circuit component is connected between a pair of wires extending from the rear, non-mating end of the connector. These wires are not necessarily part of any of the circuits which are connected with the wire harness terminals which connect with the mating connector.

In a second embodiment of the invention, a bus bar connects the circuit component with one of the wire harness terminals, so that the component is part of one of the circuits which is connected through the mating connector.

Also in a preferred embodiment, the receptacle has an open end for receiving the circuit component oriented toward the mating end of the housing. This allows engagement of the connector with the mating connector to secure the circuit component in the receptacle.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figures 1, 2:
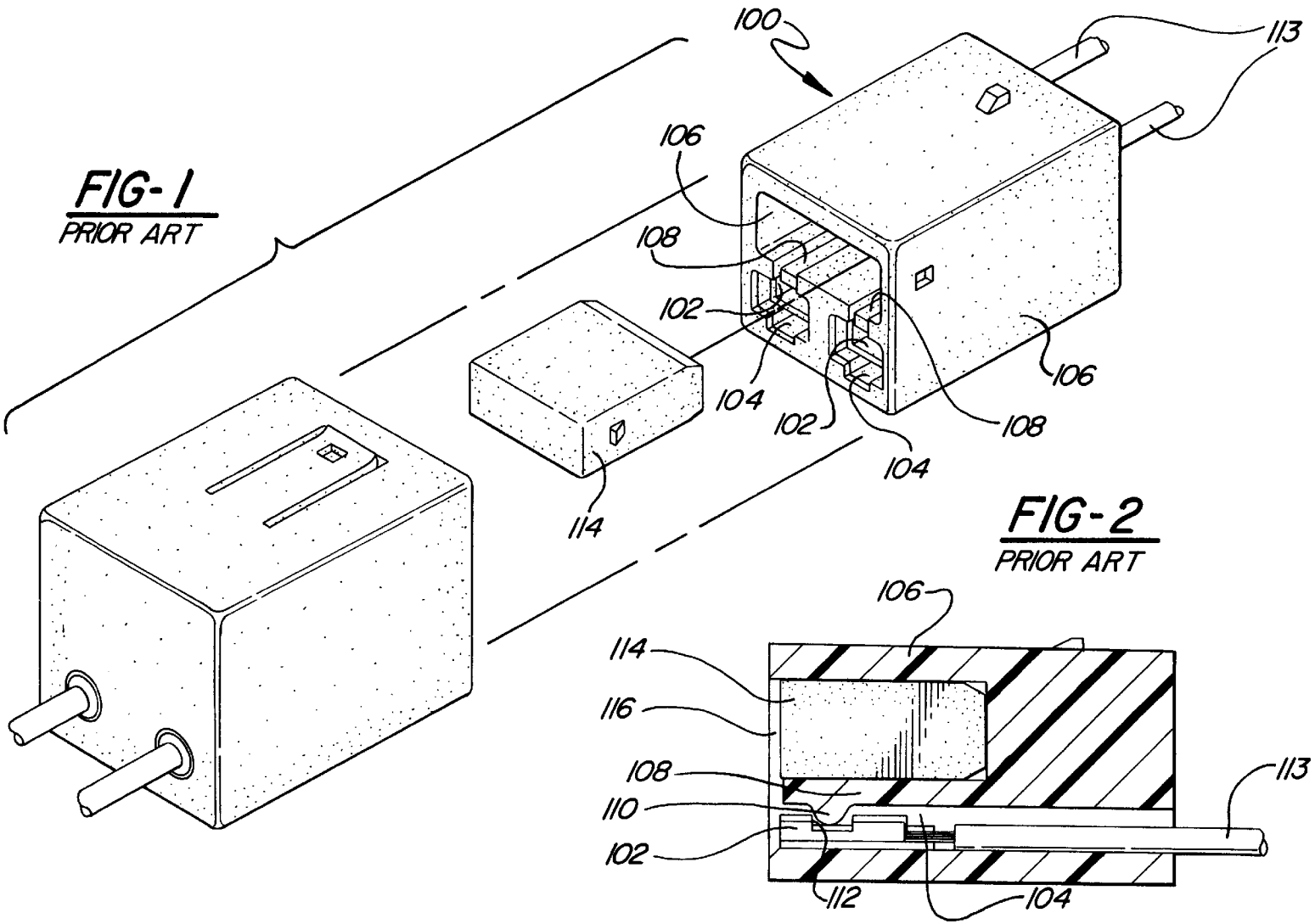
FIG-1 PRIOR ART
FIG-2 PRIOR ART
FIG. 1 is an exploded perspective view of a prior art electrical connector having a locking wedge.
FIG. 2 is a cross-sectional view of the prior art connector of FIG. 1, showing the locking wedge inserted in its receptacle.
Figure 3:
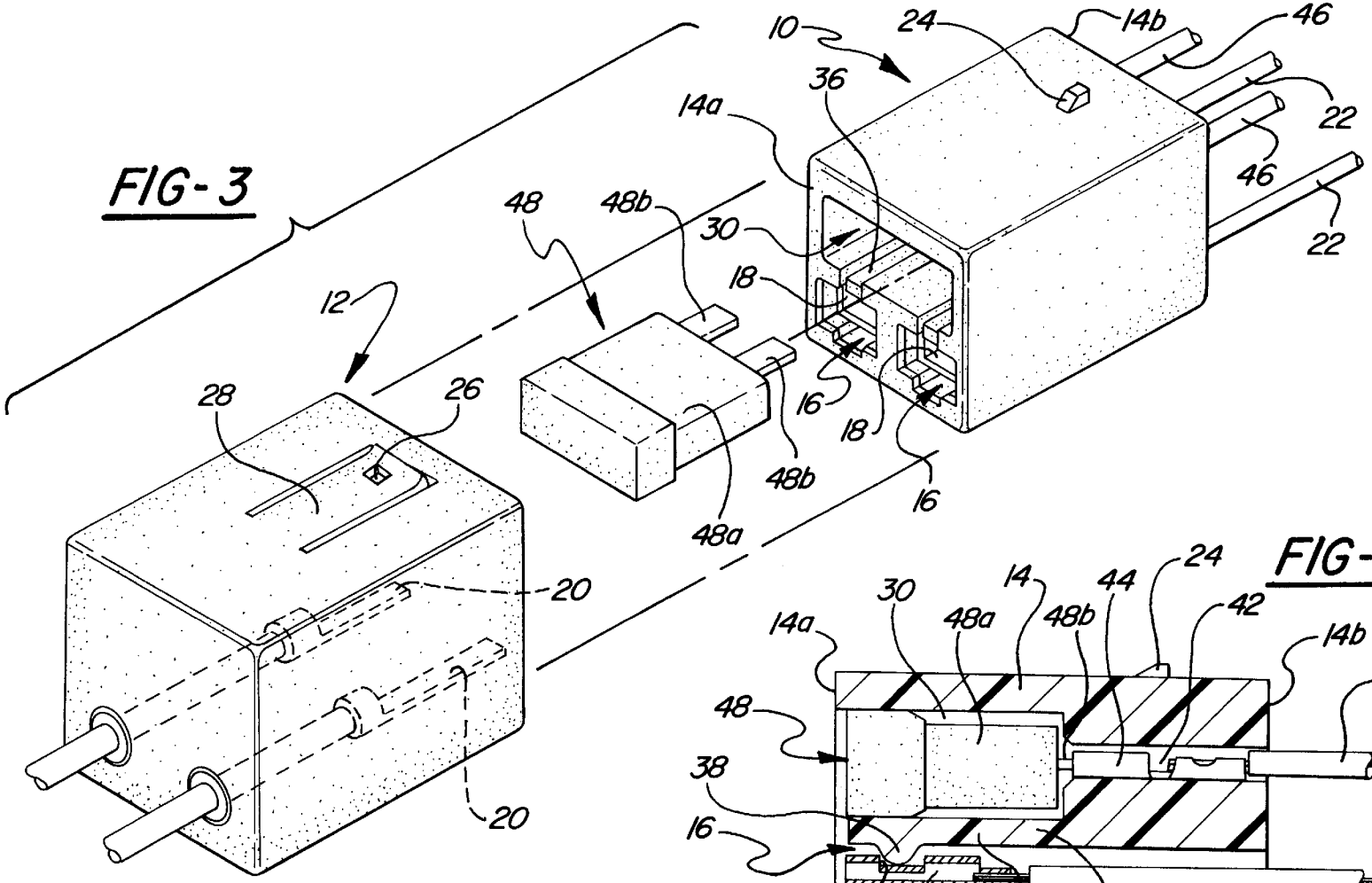
FIG. 3 is an exploded perspective view of a connector according to the present invention.
Figure 4:
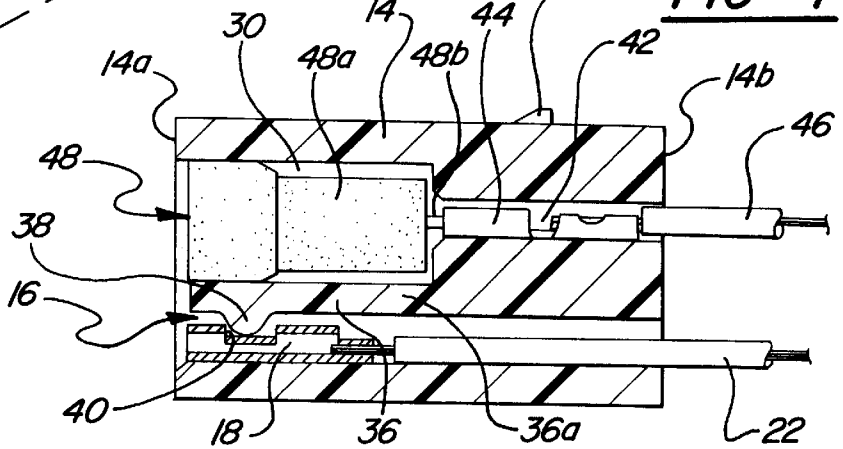
FIG. 4 is a cross-sectional view of the invention connector taken along line 4—4 of FIG. 3, showing the circuit component inserted in its receptacle.

FIGS. 3 and 4 show an electrical connector according to the present invention, generally indicated by reference number 10, along with a mating connector 12 engagable with the invention connector 10. The connector 10 comprises a substantially hollow housing 14, preferably formed of plastic, which defines two chambers 16 each of which contains a female wiring harness terminal 18. The terminals 18 are positioned with their open ends oriented toward and adjacent a front or mating end 14*a* of the housing so as to be placed in mating connection with male terminals 20 contained in the mating connector 12 when the two connectors 10,12 are engaged with one another. The female terminals 18 are crimped, soldered or otherwise connected to wires 22 which extend from a rear end 14*b* of the housing. A detent ramp 24 projects from the upper surface of the housing 14 and engages a hole 26 in a latch tab 28 formed integrally with the mating connector 12 when the two connectors 10,12 are mated with one another, thereby securing the connectors in engagement.

The connector housing 14 further defines a locking wedge receptacle 30 disposed adjacent the terminal chambers 16 and extending substantially the entire width of the housing 14. Locking wedge receptacle 30 is preferably identical to the receptacles present in prior art connectors for receiving an inert locking wedge device. An internal wall 32 extends horizontally across the housing 14 between the locking wedge receptacle 30 and the terminal chambers 16. Pairs of parallel slots extend into the internal wall 32 from the front end 14*a* of the housing 14 to define therebetween latch members 36 above each of the terminal chambers 16. The latch members 36 are attached to the housing 14 at their inner ends 36*a*. Each latch member 36 has a nub 38 formed on its lower surface adjacent its free end and projecting downwardly into its respective terminal chamber 16.

During assembly of the connector 10, a terminal 18 and its attached wire 22 is inserted into each chamber 16 from the rear end 14*b* of the housing. The tip of the terminal 18 contacts the nub 38 and the latch member 36 flexes upwardly to allow the terminal 18 to pass beneath. When the terminal 18 is fully inserted into its respective chamber 16, the latch member 36 snaps back downwardly so that the nub 38 engages a shoulder 40 of the terminal, thereby securing the terminal within its chamber.

A second pair of terminal chambers 42 (see FIG. 4) extend between the locking wedge receptacle 30 and the rear end 14*b* of the housing and contain a pair of electrical component terminals 44 connected to wires 46 extending from the rear of the connector.

A circuit component 48 such as a fuse, diode, resistor, or the like comprises a body 48*a* sized to be snugly received by the locking wedge receptacle 30, and a pair of flat, blade-like contacts 48*b*. In a preferred embodiment of the invention, the circuit component 48 is a positive temperature coefficient (PTC) device 48 for protecting the circuit against overcurrent conditions. A PTC device may be made very small so that it may be used in a receptacle sized to accept a prior art, inert locking wedge.

The PTC device 48 is inserted into the locking wedge receptacle 30 from the front end 14*a* of the housing so that its contacts are received by the electrical component terminals 44. When inserted fully into the locking wedge receptacle 30, the body 48*a* of the PTC device substantially fills the locking wedge receptacle 30 in the manner of a conventional, inert locking wedge so that it prevents the latch members 36 from being able to flex upwardly, maintaining the latch members in engagement with their respective terminals 18 to lock them in place. The PTC device 48 thus serves a dual purpose, protecting the circuit of the wires 46 connected to the electrical component terminals 44 while simultaneously acting as locking wedge to retain the wire harness terminals 18 securely within the housing 14 and preventing them from being forced rearwardly out of their respective chambers 16 when the male terminals 20 of the mating connector 12 are inserted therein.

If desired, the electrical component terminals 44 may be secured in place within their chambers 42 by a rear holder (not shown) of the type well known in the connector art. Such a rear holder snaps into engagement with the housing 14 adjacent its rear end 14*a* and blocks extraction of terminals in that direction.

It is to be understood that a connector according to the present invention may include any number of terminal chambers. A connector according to the invention may also have two parallel rows of terminal chambers, with the locking wedge receptacle 30 located between the rows. In such a connector, the circuit component body is shaped to wedge outwardly against latch members disposed adjacent both sides of the component.

Figure 5:
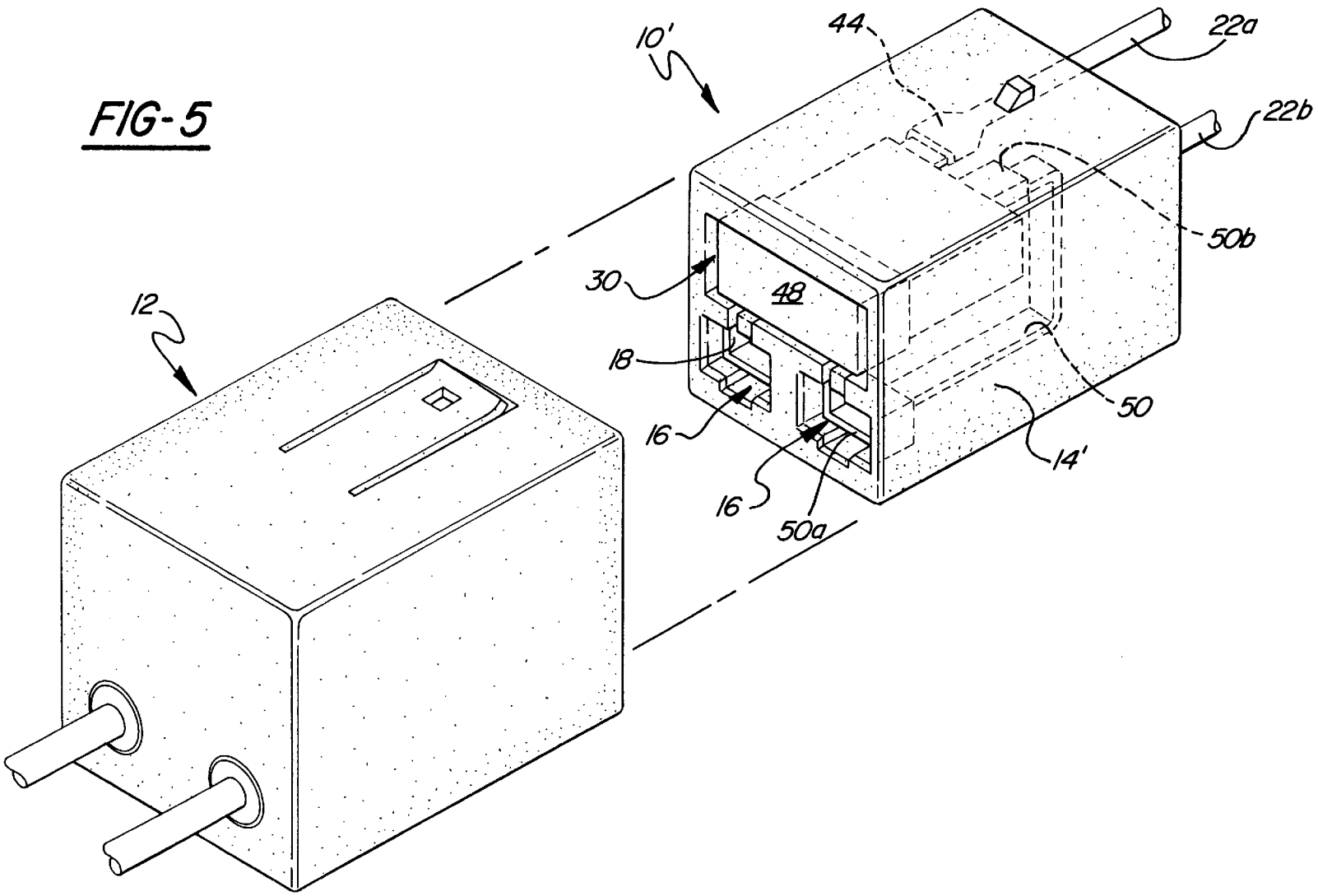
FIG. 5 is a perspective view of a second embodiment of the invention connector.
Figure 6:
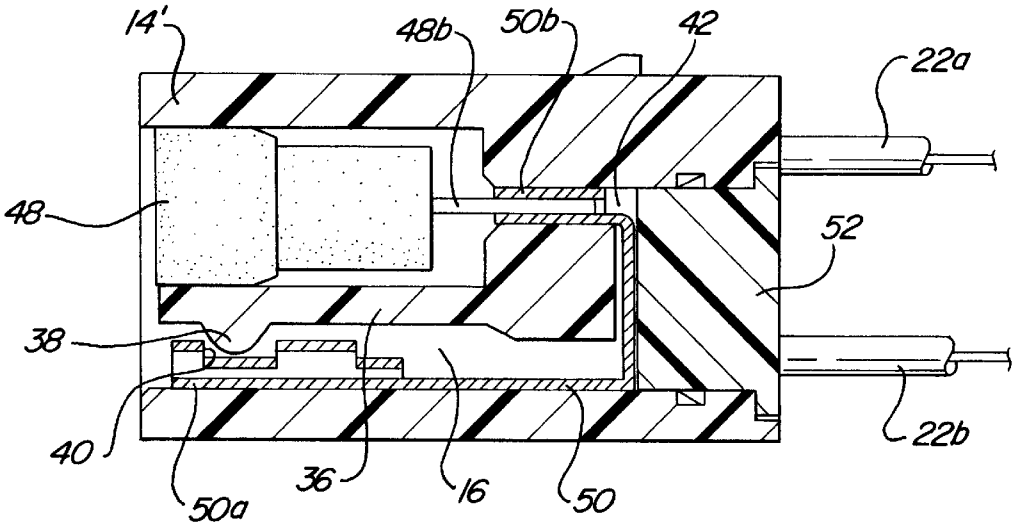
FIG. 6 is a cross-sectional view of the connector of FIG. 5.
Figure 7:
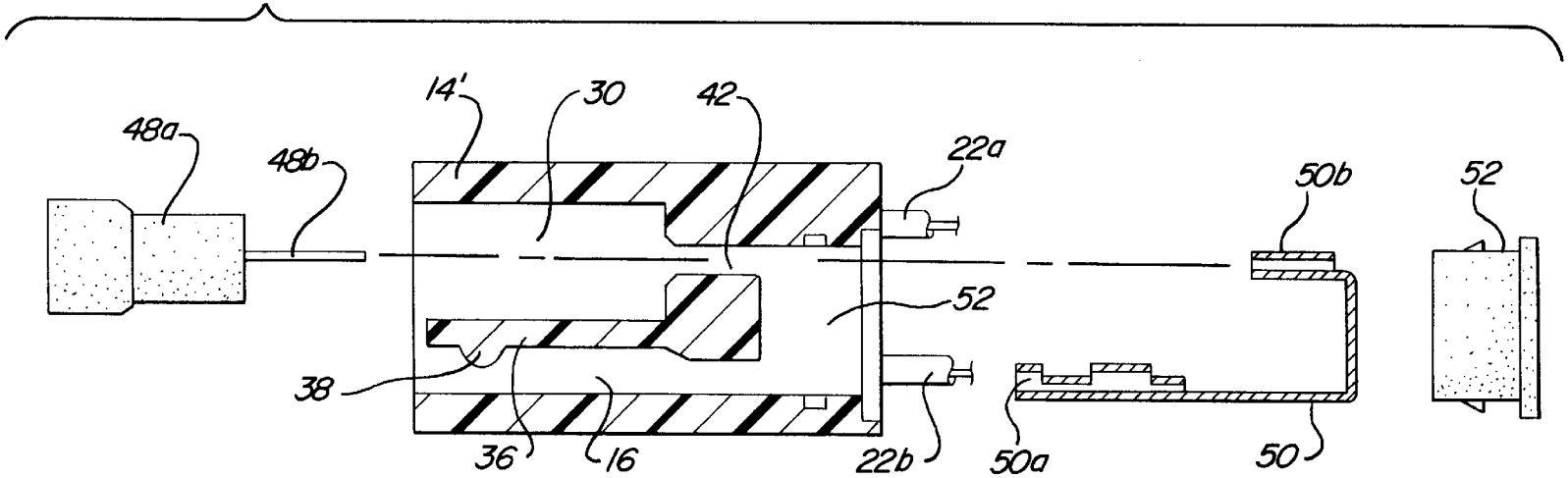
FIG. 7 is an exploded view similar to FIG. 6.

An alternative embodiment of the inventive connector 10' is shown in FIGS. 5–7. The connector housing 14' is generally similar in external configuration to that of the first described embodiment, having two wire harness terminal chambers 16, a locking wedge receptacle 30 for a PTC device 48, two electrical component terminal chambers 42 at the rear of the locking wedge receptacle, and latch members 36 disposed between the wire harness terminal chambers and the locking wedge receptacle.

In contrast to the first embodiment, however, only one of the wire harness terminal chambers 16 is occupied by a female wire harness terminal 18, and only one of the electrical component terminal chambers 42 is occupied by a electrical component terminal 44. An electrically conductive bus bar 50 extends between the remaining wire harness terminal chamber 16 and the remaining electrical component terminal chamber 42. A first end 50*a* of the bus bar disposed in the wire harness terminal chamber 16 is configured substantially identical to the female terminal 18 retained in the other wire harness terminal chamber so that it may mate with a male terminal 20 in the mating connector 12. The opposite end 50*b* of the bus bar is configured to receive the second of the of the PTC contacts 48*b*. Wire harness terminal 18 is connected to wire 22*b* and electrical component terminal 44 is connected to wire 22*a*.

As seen in FIGS. 6 and 7, an opening 52 is formed in the rear end of the housing 14' to allow the bus bar 50 to be inserted therein. A rear holder 54 is inserted into the opening 52 after the bus bar 50 is inserted, snapping into engagement with the housing 14' to retain the bus bar in position. The rear holder 54 may also serve to retain the electrical component terminal 44 in its chamber 42.

When the PTC device 48 is inserted into the locking wedge receptacle 30, one of its contacts 48*b* connects with the electrical component terminal 44 and its other contact connects with the bus bar 50. Subsequent engagement of the connector 10 with the mating connector 12 places the PTC device 48 in series with the circuit formed by wire 22*a* and the mating terminal of connector 12, thereby protecting the circuit that is connected through the wire harness terminals.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. An electrical connector assembly comprising:

a housing defining a plurality of terminal chambers;

a plurality of first terminals housed within the terminal chambers for making connection with terminals of a mating connector;

a receptacle defined by the housing adjacent the terminal chambers;

a plurality of second terminals adjacent the receptacle and in communication therewith;

at least one latch member separating at least one terminal chamber from the receptacle, the latch member engaging the first terminal in the at least one terminal chamber to retain the first terminal therein; and a circuit component insertable into the receptacle to simultaneously lock the at least one latch member in engagement with the first terminal and make electrical connection with the second terminals.

2. The electrical connector assembly according to claim 1 further comprising a bus bar connecting one of the first terminals with one of the second terminals.

3. The electrical connector assembly according to claim 1 wherein the second terminals are connected with respective wires extending from the housing.

4. The electrical connector assembly according to claim 1 wherein an open end of the receptacle for receiving the circuit component is oriented toward a mating end of the housing engagable with the mating connector, said engagement with the mating connector securing the circuit component in the receptacle.

5. The electrical connector assembly according to claim 1 wherein the circuit component comprises an overcurrent protection device.

6. The electrical connector assembly according to claim 5 wherein the overcurrent protection device is a positive temperature coefficient device.

7. An electrical connector assembly comprising:

a housing defining a plurality of first terminal chambers;

a plurality of first terminals housed within the first terminal chambers for making connection with terminals of a mating connector;

a receptacle defined by the housing adjacent the first terminal chambers and having a plurality of second terminals in communication therewith;

at least one latch member separating at least one first terminal chamber from the receptacle, the latch member engaging the first terminal in the at least one first terminal chamber to retain the first terminal therein; and a circuit component having a body configured to fit into the receptacle and maintain the latch member in engagement with the respective terminal and to make electrical connection with the second terminals.

8. The electrical connector assembly according to claim 7 further comprising a bus bar connecting one of the first terminals with one of the second terminals.

9. The electrical connector assembly according to claim 7 wherein the second terminals are connected with respective wires extending from the housing.

10. The electrical connector assembly according to claim 7 wherein an open end of the receptacle for receiving the circuit component is oriented toward a mating end of the housing engagable with the mating connector, said engagement with the mating connector securing the circuit component in the receptacle.

11. The electrical connector assembly according to claim 7 wherein the circuit component is an overcurrent protection device.

12. The electrical connector assembly according to claim 11 wherein the overcurrent protection device is a positive temperature coefficient device.

13. An electrical connector assembly comprising:

a housing defining a receptacle;

a plurality of first terminals adjacent to and in communication with the receptacle;

a circuit component insertable into the receptacle to make contact with the first terminals;

a plurality of second terminals retained within the housing for making connection with terminals of a mating connector; and a plurality of latching members disposed between the receptacle and the second terminals, the latching members having first positions wherein the latching members retain the respective second terminals in the housing and deflectable to second positions wherein they do not retain the second terminals in the housing, insertion of the circuit component into the receptacle contacting the latching members to maintain them in the first positions.

14. The electrical connector assembly according to claim 13 further comprising a bus bar connecting one of the first terminals with one of the second terminals.

15. The electrical connector assembly according to claim 13 wherein the first terminals are connected with respective wires extending from the housing.

16. The electrical connector assembly according to claim 13 wherein an open end of the receptacle for receiving the circuit component is oriented toward a mating end of the housing engagable with the mating connector, said engagement with the mating connector securing the circuit component in the receptacle.

17. The electrical connector assembly according to claim 13 wherein the circuit component comprises an overcurrent protection device.

18. The electrical connector assembly according to claim 17 wherein the overcurrent protection device is a positive temperature coefficient device.

* * * * *